US006049265A

United States Patent [19]

Hähnel et al.

[11] Patent Number: 6,049,265

[45] Date of Patent: Apr. 11, 2000

[54] LOAD DISCONNECTING SWITCH, IN PARTICULAR FOR THE LOAD CIRCUIT OF A MOTOR VEHICLE BATTERY

[75] Inventors: Thomas Hähnel; Jürgen Breitlow-Hertzfeldt; Thomas Büscher; Heiko Reiss, all of Berlin, Germany

[73] Assignee: Siemens Aktiengesellschaft, Munich, Germany

[21] Appl. No.: 09/341,987

[22] PCT Filed: Jan. 21, 1998

[86] PCT No.: PCT/DE98/00178

§ 371 Date: Jul. 21, 1999

§ 102(e) Date: Jul. 21, 1999

[87] PCT Pub. No.: WO98/32144

PCT Pub. Date: Jul. 23, 1998

[30] Foreign Application Priority Data

Jan. 21, 1997 [DE] Germany ..... 197 01 933

[51] Int. Cl.[7] ..... H01F 7/08

[52] U.S. Cl. ..... 335/220; 335/185; 335/189

[58] Field of Search ..... 439/555, 754, 439/755; 335/220, 224, 225, 228, 236, 237, 238, 239, 185, 186, 187–188, 189, 190, 177–179

[56] References Cited

U.S. PATENT DOCUMENTS 5,568,113 10/1996 Chen ..... 335/195

5,612,659 3/1997 Kerber ..... 335/177

FOREIGN PATENT DOCUMENTS

| | | |
|---|---|---|
| 0 150 920 | 8/1985 | European Pat. Off. . |
| 0 331 384 | 9/1989 | European Pat. Off. . |
| 0 725 412 A2 | 8/1996 | European Pat. Off. . |
| 41 10 240 C1 | 10/1992 | Germany . |
| 197 12 544 A1 | 6/1997 | Germany . |
| 483 114 | 1/1970 | Switzerland . |
| 2 260 635 | 4/1993 | United Kingdom . |

*Primary Examiner*—Lincoln Donovan
*Attorney, Agent, or Firm*—Hill & Simpson

[57] ABSTRACT

The load section switch is connected between a pole post (4) and a main circuit (8) with a contact arrangement (14, 15, 36). Via a manually actuated switch arm (45), the contact arrangement can be locked in its closed condition, whereby the locking ensues via a switch pawl (39). This switch pawl (39), on the other hand, is coupled to the armature (28) of an electromagnet system (26, 27). In this way, the contact arrangement can be unlocked and the circuit can be interrupted via the electromagnet system given the occurrence of a malfunction condition. Given an accident or a short, the on-board network of a motor vehicle can be quickly disconnected from the current with this section switch in order to reduce the risk of fire or to prevent a discharge of the battery given some other malfunction condition.

17 Claims, 4 Drawing Sheets

LOAD DISCONNECTING SWITCH, IN PARTICULAR FOR THE LOAD CIRCUIT OF A MOTOR VEHICLE BATTERY

BACKGROUND OF THE INVENTION

1. Field of the Invention

The present invention is directed to a battery section switch, particularly for the load circuit of a motor vehicle battery, whereby the load circuit can be automatically opened via an electromagnet system.

2. Description of the Related Art

It is desirable in motor vehicles during certain malfunctions to suddenly disconnect the on-board network from the electrical current as close as possible to the battery. Such instances are, for example, a short in the load circuit that can lead to the discharge of the battery or to a motor vehicle fire, a pole reversal when jumping that can lead to damage to the battery but also to a destruction of the electronic systems in the on-board network or a collision accident as well wherein shorts with a fire risk resulting therefrom can likewise arise.

German Patent Document DE 41 10 240 C1 already discloses a means for fusing a main current path in a motor vehicle. A short-circuit situation is thereby detected by various sensors and comparison means and is interpreted for separating the circuit. A percussion cap or an electromagnetic actuator are cited therein as a disconnect means by way of example, without the design and the function of such an actuator being discussed in greater detail.

European Patent Document EP 0 725 412 A2 also discloses a fuse device for a current conductor in motor vehicles, whereby a sensor for the intensity of the current controls a following separating means with which the current conductor is interrupted given excess current. In detail, separating means having a percussion cap are cited therein, whereby a cable is cut or a plug is pressed out of the housing when the separating means triggering. After the trigger of such separating means, a re-engagement is not possible without further ado even after elimination of the malfunction; on the contrary, the fuse element must be replaced.

European Patent Document EP 0 331 348 A2 discloses a section switch with a manual actuation element, whereby, for example, the response of an electromagnet system unlocks a lock mechanism, so that a contact pair opens. This lock mechanism, however, is relatively complicated in structure.

SUMMARY OF THE INVENTION

A goal of the present invention is to create a battery section switch, particularly for separating the motor vehicle battery in critical situations, that has a compact structure so that it can be accommodated in a tight space directly in the area of the battery post. Moreover, this battery section switch should enable a manual re-engagement of the on-board network as soon as the malfunction has been eliminated. It should thereby also be possible to design the battery section switch such that the load circuit can also be manually disconnected, for example when the motor vehicle stands still for a longer time.

This goal is inventively achieved with a battery section switch having the following features:

an electromagnet system whose armature is coupled to a switch pawl;

an input conductor connectable to a pawl post of a battery;

an output conductor connectable to the load circuit;

a movable contact element for producing a switched connection between the input conductor and the output conductor;

a contact carrier carrying the movable contact element that can be pivoted between a closed position and an opening position and is pre-stressed into the opening position by a break away spring;

a setting arm that can be brought into engagement with the contact carrier and with which the switch pawl can be locked to the contact carrier in articulated fashion, whereby the contact carrier comprises a guide slot proceeding approximately in its rotational sense wherein a setting peg of the setting arm engages and that, together with the switch pawl coupled to the armature, is seated pivotable around a pawl axis parallel to the rotational axis thereof such that, when the magnet system is not excited, it locks the setting peg with a locking hook to prevent a displacement in the guide slot;

a manual actuation element for moving the setting arm in the direction toward the contact carrier and for the locking thereof in an engaged position;

whereby the contact carrier, the setting arm and the manual actuation element interact such that —when the magnet system is not excited, the switch pawl locks the setting arm against the contact carrier and the setting arm, in its engaged position, prestresses the contact carrier into the closed position;

—when the magnet system is excited, the switch pawl unlocks the setting arm and the contact carrier is brought into the opening position by the break away spring.

In an advantageous embodiment, the input conductor and the output conductor respectively comprise fixed contacts aligning with one another, whereby the movable contact piece is a bridge contact piece that connects the

LOAD SECTION SWITCH, PARTICULARLY FOR THE LOAD CIRCUIT OF A MOTOR VEHICLE BATTERY

The invention is directed to a load section switch, particularly for the load circuit of a motor vehicle battery, whereby the load circuit can be automatically opened via an electromagnet system.

It is desirable in motor vehicles in certain malfunctions to suddenly disconnect the on-board network from the current as close as possible to the battery. Such instances are, for example, a short in the load circuit that can lead to the discharge of the battery or to a motor vehicle fire, a pull reversal when jumping that can lead to damage to the battery but also to a destruction of the electronic systems in the on-board network or a collision accident as well wherein shorts with a fire risk resulting therefrom can likewise arise.

DE 41 10 240 C1 already discloses a means for fusing a main current path in a motor vehicle. A short-circuit situation is thereby detected by various sensors and comparison means and is interpreted for separating the circuit. A percussion cap or an electromagnetic actuator are cited therein as disconnect means by way of example, without the design and the function of such an actuator being discussed in greater detail.

EP 0 725 412 A2 also discloses a fuse device for a current conductor in motor vehicles, whereby a sensor for the intensity of current controls a following separating means with which the current conductor is interrupted given excess current. In detail, separating means having a percussion cap are cited therein, whereby a cable is cut or a plug is pressed out of the housing when the separating means triggers. After the trigger of such separating means, a re-engagement is not possible without further ado even after elimination of the malfunction; on the contrary, the fuse element must be replaced.

A goal of the present invention is to create a load section switch, particularly for separating the motor vehicle battery in critical situations, that has a compact structure so that it can be accommodated in a tight space directly in the area of the battery post. Moreover, this load section switch should enable a manual re-engagement of the on-board network as soon as the malfunction has been eliminated. It should thereby also be possible to design the load section switch such that the load circuit can also be manually disconnected, for example when the motor vehicle stands still for a longer time.

This goal is inventively achieved with a load section switch having the following features:

an electromagnet system whose armature is coupled to a switch pawl;

an input conductor connectable to a pawl post of a battery;

an output conductor connectable to the load circuit;

a movable contact element for producing a switched connection between the input conductor and the output conductor;

a contact carrier carrying the movable contact element that can be pivoted between a closed position and an opening position and is pre-stressed into the opening position by a tear spring;

a setting arm that can be brought into engagement with the contact carrier and with which the switch pawl can be locked to the contact carrier in articulated fashion;

a manual actuation element for moving the setting arm in the direction toward the contact carrier and for the locking thereof in an engaged position;

whereby the contact carrier (34), the setting arm (45) and the manual actuation element (49) interacts such that when the magnet system is not excited, the switch pawl locks the setting arm against the contact carrier and the setting arm, in its engaged position, pre-stresses the contact carrier into the closed position;

when the magnet system is excited, the switch pawl unlocks the setting arm and the contact carrier is brought into the opening position by the tear spring.

In an advantageous embodiment, the input conductor and the output conductor respectively comprise fixed contacts aligning with one another, whereby the movable contact piece is a bridge contact piece that connects the two fixed contacts. However, an embodiment would also be possible with a simple contact, whereby the movable contact piece or, respectively, the contact carrier would be electrically connected to the input conductor or the output conductor via a stranded conductor.

The contact carrier can be a spring clamped at one side or can be a contact rocker. Such a contact rocker is rotatably seated in an advantageous embodiment, and it comprises a first lever arm carrying the movable contact piece as well as a second lever arm that interacts with the setting arm. The first lever arm can thereby be entirely or partially formed by a leaf spring secured to the contact rocker. In one embodiment of the invention, the second lever arm comprises a guide slot proceeding approximately in its rotational direction into which a setting peg of the setting arm engages; the switch pawl coupled to the armature is thereby preferably pivotably seated on the second lever arm around a pawl access parallel to the rotational axis thereof, being pivotably seated such that, when the magnet system is not excited, it has a locking hook locking the setting peg to prevent displacement in the guide slot. The switch pawl is thereby preferably pre-stressed into its locking position by a pawl spring. As a result of this pivotable bearing of the switch pawl on the contact rocker, it is possible that the switch pawl follows the movements of the contact rocker and thereby retains its position relative to the setting peg, i.e., for example given manual actuation of the section switch, keeps the interlock of the setting peg closed while the contact rocker is rotated into the closed position.

The actuation of the switch pawl, on the other hand, ensues via the magnet system independently of the switch position of the contact rocker. A magnet system with a lift armature is preferably employed, whereby the latter is in engagement with the switch pawl via a trigger peg. This engagement expediently ensues via an oblong hole in the switch pawl that proceeds approximately along the rotary motion of the contact rocker, so that the position of the magnet system or, respectively, of the lift armature is always identically transferred onto the locking condition of the setting peg independently of the rotary position of the contact rocker.

In a preferred embodiment, the setting arm itself together with the actuation element forms a toggle lever system that, in its elongated condition, acts approximately in closing direction of the contact rocker on the second lever arm thereof and whose articulation point is pre-stressed against a detent by the break away spring when the dead point is passed. In this way, the closed condition of the contact system is kept stable by the toggle lever after passing the dead point, as long as the setting peg remains locked to the contact rocker.

The drive of the section switch can ensue via known sensors, for example an acceleration sensor serving as impact sensor or a current sensor serving as short-circuit sensor, whereby an electronic evaluation circuit together with the section switch can be accommodated in a housing directly at the battery post.

BRIEF DESCRIPTION OF THE DRAWINGS

The invention is explained in greater detail below with reference to an exemplary embodiment on the basis of the drawing.

DETAILED DESCRIPTION OF THE PREFERRED EMBODIMENTS

Figure 1:
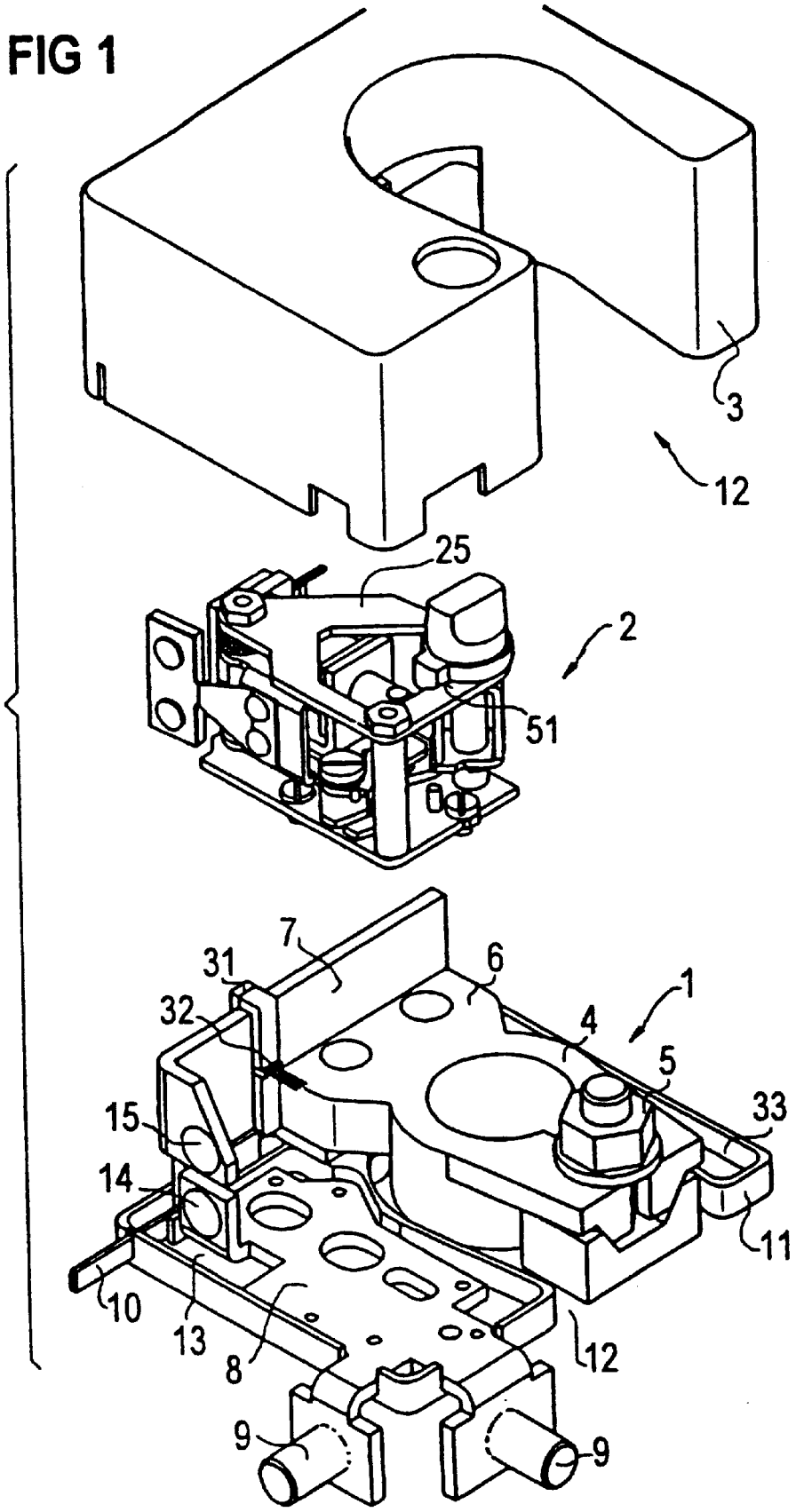
FIG. 1 is an inventively fashioned battery section switch with its principal assemblies shown in an exploded perspective view.

According to FIG. 1, the battery section switch shown in FIGS. 1 through 4 is composed of a bottom group 1 with a housing base 11, as well as of the actual switch assembly 2 and of a housing cap 3. The housing formed of the housing base 11 and the cap 3 has a recess 12 for a battery post 4 that has a known structure and that can be clamped with a screw 5 to a battery pole, normally the positive pole of a motor vehicle battery. A projection 6 of the battery post projects through a recess in the housing cap 3 and is electrically and mechanically firmly connected to an input conductor 7 in the inside of the housing. Both the battery post 4 as well as the input conductor 7 are composed of highly conductive metal in order to be able to carry the current for the entire on-board network of the vehicle.

An output conductor 8 that carries a fixed contact 14 at a bent-off section is arranged in a switch chamber 13. This lies in alignment in a plane with a fixed contact 15 of the input conductor 7. The two fixed contacts are connected by the section switch, as shall be described later. Two terminals 9 for connection to the motor vehicle circuits are conducted toward the outside from the output conductor 8. Moreover, an emergency current terminal 10 is branched off from the input conductor 7 and is likewise conducted toward the outside from the housing while bypassing the section switch. This serves the purpose of supplying safety functions, for example a warning blinker, car telephone, etc., with a low power consumption after the separation of the main circuits from the battery.

Figure 2:
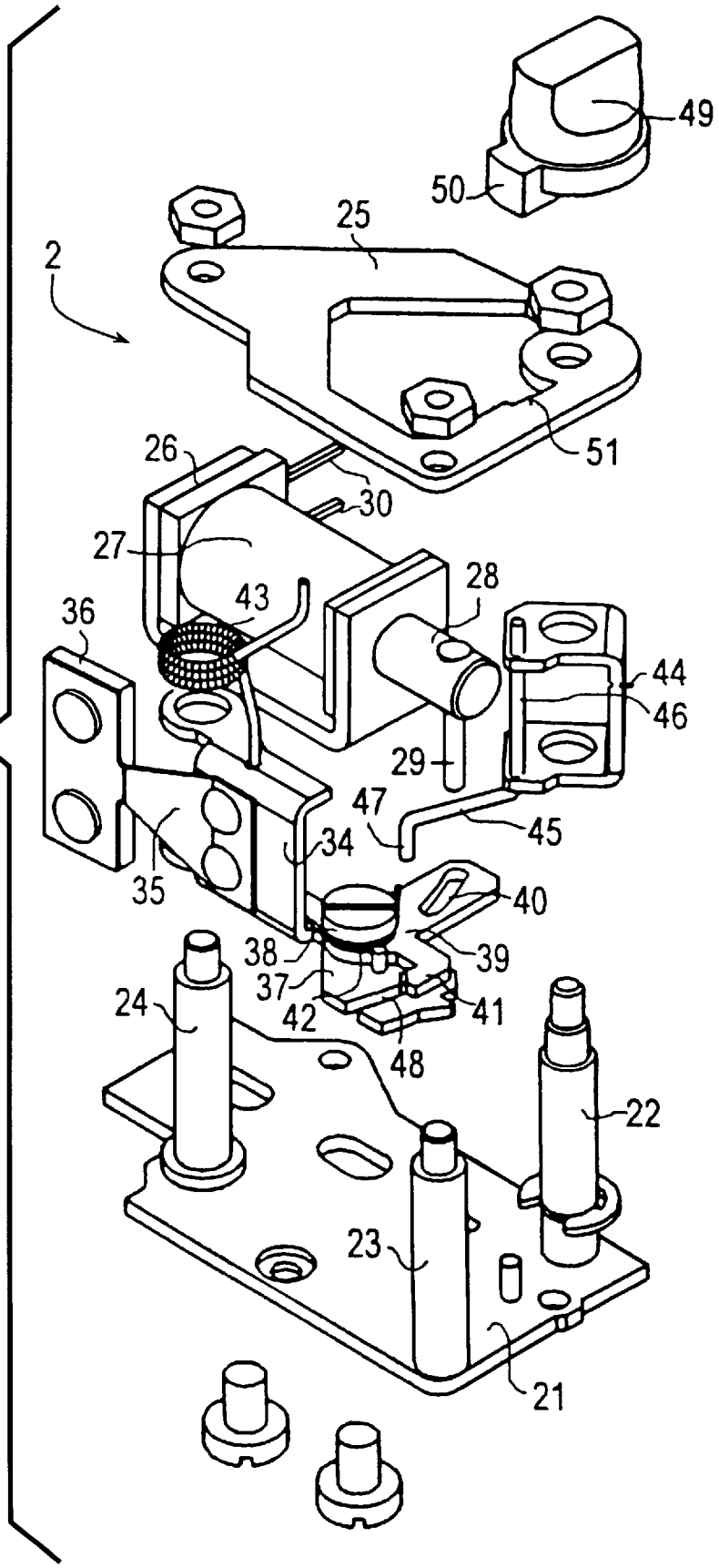
FIG. 2 is the actual switch assembly portion of FIG. 1 shown in an exploded perspective view.

The actual switch assembly 2, which is shown in terms of its discrete parts in FIG. 2, is arranged on the output conductor 8 in the switch chamber 13. It has an insulating base plate 21 of insulating material with three connectors 22, 23 and 24 that carry a frame-shaped cover plate 25 via screwed, or threaded connections. An electromagnet system 26 with a coil 27 and a lift armature 28 is likewise secured on the base plate 21. The lift armature 28 is pulled into the coil when the magnet system is excited, whereby a trigger pin 29 arranged at its end perpendicular to the axis is likewise actuated in this direction.

A trigger signal is supplied to the magnet system via coil terminals 30, this not being shown in greater detail here. This trigger sensor can come from an arbitrary sensor in the vehicle, for example from an impact acceleration sensor or from a current or, respectively, short-circuit sensor or the like, and can be supplied to the coil 27 via an evaluation means (not shown). A current sensor having a ferrite ring 31 and a Hall sensor 32 is shown in FIG. 1, without the connection of the terminal elements of the Hall element to the evaluation circuit being shown. Such an evaluation circuit could, for example, be arranged in an additional circuit chamber 33 of the housing (FIG. 1).

The connector 24 on the base plate 21 simultaneously serves as swivelling axis for a contact rocker 34 that is rotatably seated around an axis perpendicular to the coil axis in this way. The contact rocker 34 carries a contact spring 35 that extends according to a direction next to the swivelling axis as a lever arm and carries a bridge contact piece 36 at its end. This bridge contact piece 36 resides opposite the fixed contacts 14 and 15 and connects the input conductor 7 to the output conductor 8 with these in the closed condition.

The contact rocker 34 also has a second lever arm 37 that extends approximately parallel to the armature 28. A switch pawl 39 that proceeds into engagement with the trigger pin 29 via an oblong hole 40 is seated on this second lever arm 37 with a screw pin 38 as a swivelling axis. The switch pawl 39 also has a locking hook 41 whose function shall be explained later. The switch pawl, whose swivelling axis extends parallel to the rotational axis of the contact rocker, is pre-stressed away from the armature 28 in a clockwise direction via a pawl spring 42.

The oblong hole 40 extends around the rotational axis or, respectively, connector 24 of the contact rocker 34 approximately along a circle, so that the switch pawl can be swivelled together with the contact rocker without the armature 28 with its trigger pin 29 moving. The contact rocker 34 itself is pre-stressed in the direction of an opening position of the contact bridge 36, i.e. in a counter clockwise direction, via a strong trigger spring 43. This strong break away spring assures that the load circuit is rapidly and dependently separated in an emergency.

A switch bow 44 for manual actuation is rotatably seated on the connector 22 that is provided with a corresponding spacer and with graduations. A setting arm 45 in the form of a crimped, stable wire is pivotably seated in it eccentrically and parallel to the axis, whereby the setting arm 45 itself extends from the switch bow 44 in the direction toward the contact rocker, whereas its bearing pin 46 at the switch bow 44 and a hook section 47 at its movable end respectively extend perpendicularly thereto. The hook section 47 engages into a guide slot 48 of the second lever arm 37 of the contact rocker 34 that extends approximately in the rotational sense of this contact rocker, i.e. approximately on a circular section around its rotational axis or, respectively, the connector 24. When the hook end 47 is moved inward in the guide slot 48, it engages behind the locking hook 41 and is retained by this locking hook 41 of the switch pawl 39 in the innermost region of the guide slot 48 as long as the switch pawl 39 is retained in its quiescent position by its pawl spring 42 (when the magnet system is not excited).

A switch button 49 is also seated on the connector 22 and firmly connected to the switch bow 44, so that the switch bow 44 can be turned via the switch button 49 in order to correspondingly entrain the setting arm 45. Due to the eccentric seating of the setting arm 45 via the bearing pin 46 in the switch bow 44, the setting arm 45 and the switch bow 44 together form a toggle lever system whose articulation is formed by the bearing pin 46. The toggle lever is elongated when the support 22 (as bearing axle for the switch bow 44) the bearing pin 46 and the hook section 47 lie on a line. This position forms a dead point for the movement of the switch button. A rotation of the switch button in a clockwise direction causes a tensile force on the second lever arm 37 of the contact wiper in the direction of the opening thereof via the setting arm 45. A movement of the switch button beyond the dead point in a counter-clockwise direction causes a stop cam 50 to strike a detent 51 of the cover plate 25 immediately after the dead point is passed, as a result whereof a pressure force is exerted on the lever arm 37 in a closing direction of the contact rocker via the setting arm (as long as the hook section 47 is locked in the guide slot 48).

Figure 3:
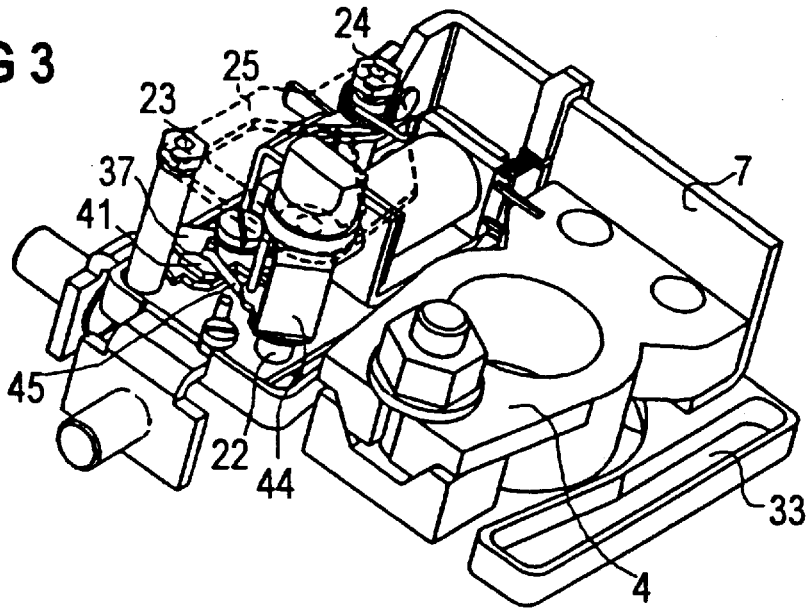
FIG. 3 and FIG. 4 show the battery section switch of FIG. 1 in its assembled condition (without housing cap) shown in a perspective view and in plan view.

In a perspective view, FIG. 3 shows the assembled section switch that, for the sake of clarity, is shown without housing cap and with a cover plate 25 only indicated with broken lines.

Figure 4:
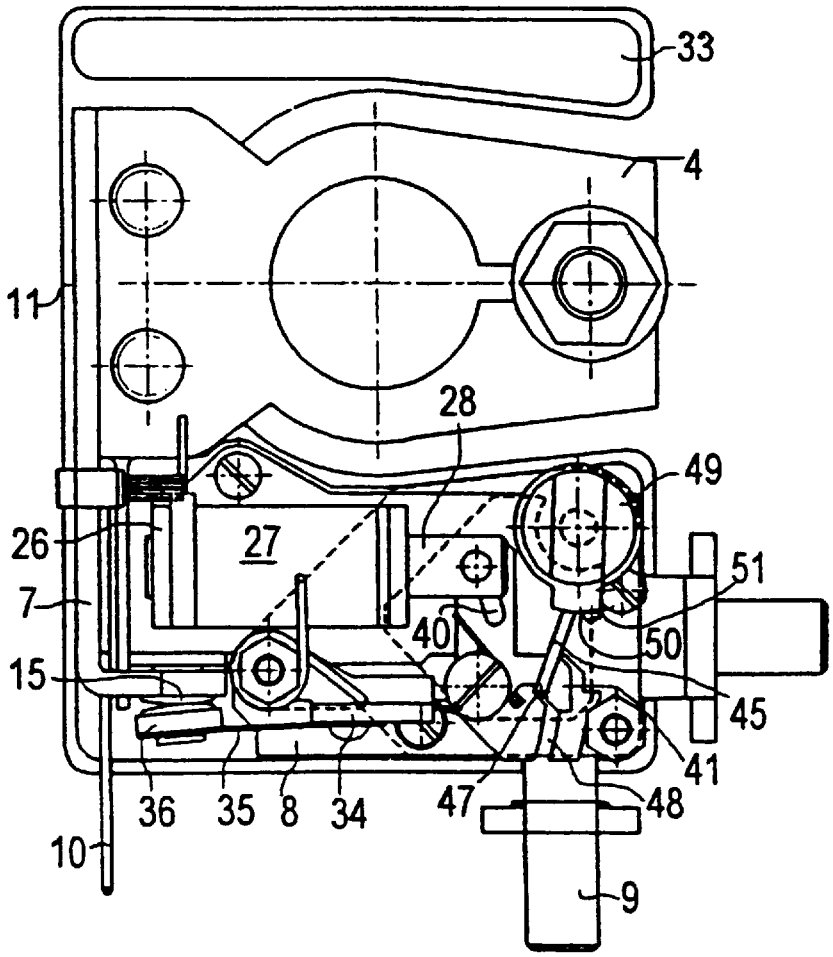

FIG. 4 shows a plan view onto the section switch in the same condition. In these illustrations, it is particularly the engagement of the setting arm 45 in the guide slot 48 of the lever arm 37 as well as the locking of the hook section 47 by the locking hook 41 of the switch pawl 39 that can be seen. This locking ensues in that the locking hook 41 partially covers the guide slot 48.

Figure 5:
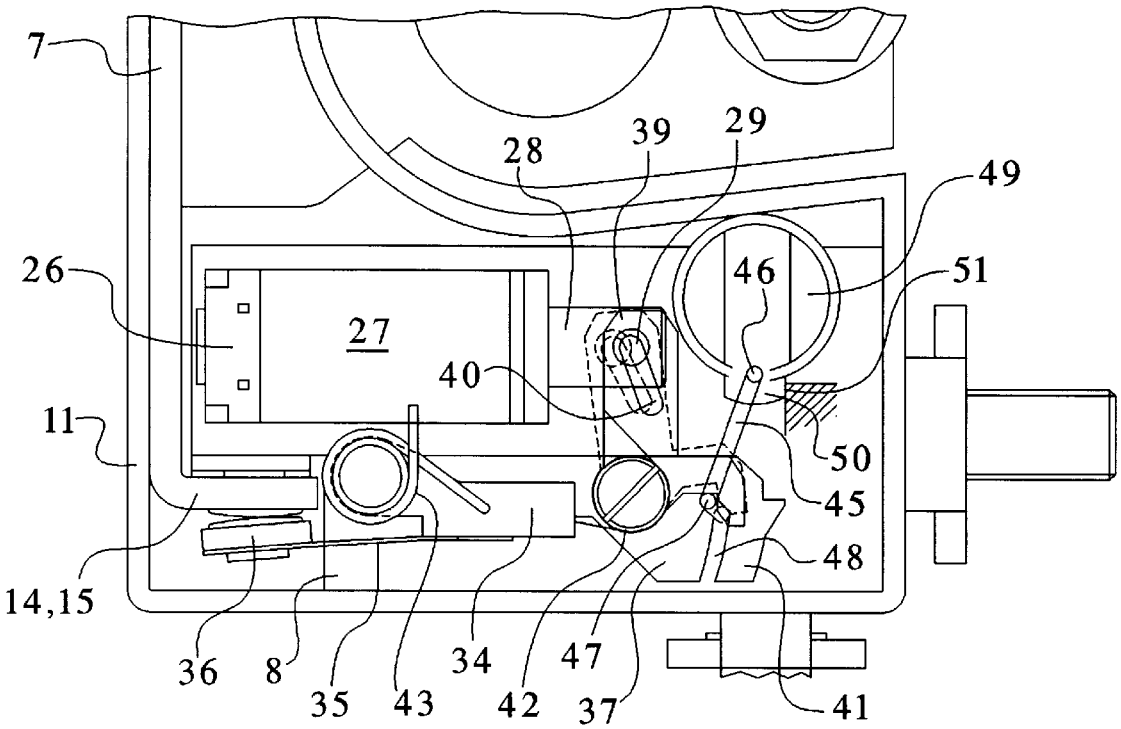
FIG. 5 and FIG. 6 show the switch assembly with its critical function elements shown in a plan view in various switch conditions.
Figure 6:
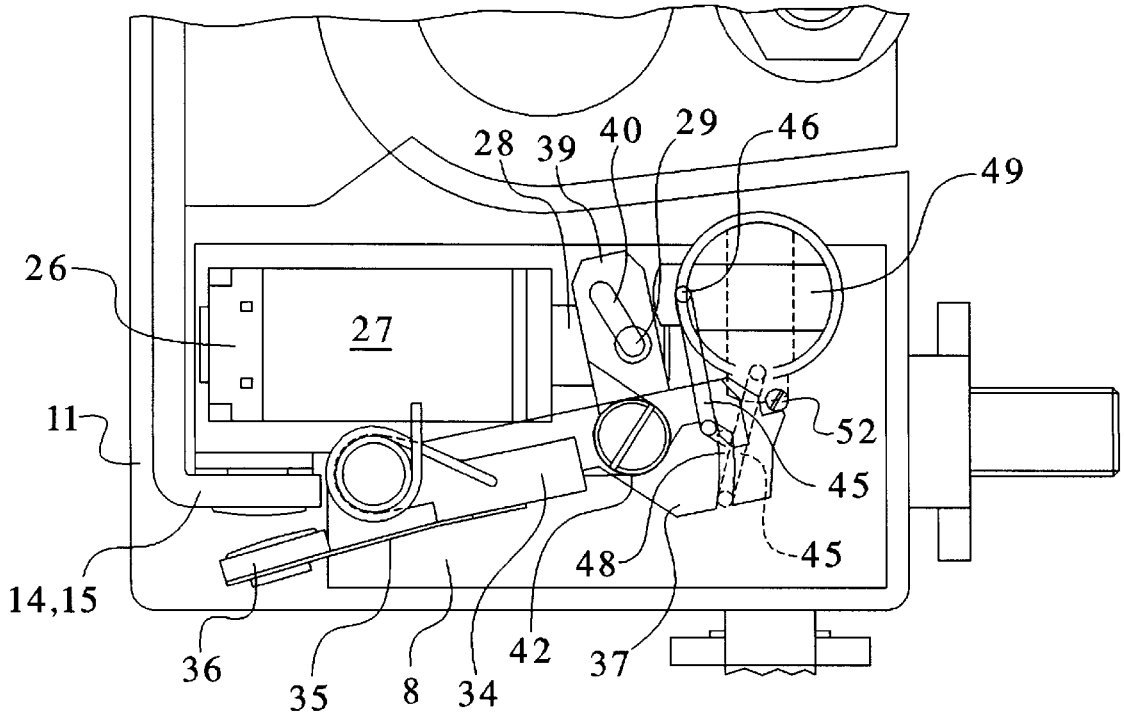

The function of the inventive section switch shall now be explained with reference to the switch positions shown in FIGS. 5 and 6. FIG. 5 shows the normal condition, i.e. with closed position of the contact rocker 34, as a result whereof the battery is connected to the on-board network of the vehicle. The switch button 49 is thereby turned in counter-clockwise direction beyond the dead point into the tensed position; in this illustrated tensed position, the stop cam 50 lies against the detent 51 of the cover plate. The setting arm 45 locked to the second lever 37 of the contact rocker exerts clockwise pressure onto the switch rocker, opposite the restoring force of the break away spring 43 and opposite the spring power of the contact spring 35. The bridge contact piece 36 is pressed with corresponding pressing power against the fixed contacts 14 and 15. The magnet system 26 is thereby not excited, so that the condition shown in FIG. 5 is retained.

By turning the switch button 49, the contact can also be opened. The switch button is thereby displaced in a clockwise direction by approximately a quarter turn, whereby the setting arm entrains the contact rocker 34 via the lever arm 37, so that the bridge contact element 36 is lifted off from the fixed contacts 14 and 15. The condition shown in FIG. 6 derives as a result thereof; the contact rocker 34 thereby has its lever arm 37 lying against a stop pin 52. The magnet system thereby continues to remain in its quiescent condition. As a result of the oblong hole 40 in the switch pawl 39, the relative motion of the switch pawl relative to the trigger pin 29 is possible. Due to the force of the break away spring, this open quiescent condition is also retained in stable fashion, regardless of whether the magnet system is excited or not. The load circuit can thus be opened and closed via the manual switch button.

When, in the closed condition according to FIG. 5, however, the magnet system 26 is excited by a control signal to the coil 27, then the lift armature 28 is pulled into the coil toward the left in the illustration of FIG. 5, as a result whereof the trigger pin 29, via the oblong hole 40, pivots the switch pawl 39 into the position shown with broken lines. As a result thereof, the locking of the setting arm 45 is canceled, since the locking hook 41 releases the guide slot 48. Due to the spring powers of the break away spring 46, the switch rocker is now turned in a clockwise direction, so that the contact opens. The relative movement between the contact rocker on the one hand and the setting arm or, respectively, the hook section 47 thereof is possible because the guide slot 48 approximately follows a circle around the rotational axis of the switch rocker. The disconnect via the magnet system is always possible as a result thereof, even when the manual rotary switch with the switch button 49 remains in the engaged position according to FIG. 5.

When the magnet is no longer excited because, for example, a short-circuit malfunction has been eliminated, the switch pawl 39 is again brought into its initial position according to FIG. 5 by the spring power of its pawl spring 42. When the switch button is then turned into the connect position according to FIG. 6 (solid lines), then the setting arm 45 couples into the guide slot 48 of the contact rocker again via its hook section 47; it thereby engages at the resiliently pre-stressed switch pawl and is again locked by the latter. When the switch knob is turned back in a clockwise direction, the setting arm can then entrain the switch rocker and close the contact. As was already mentioned, a simple contact could be employed instead of the illustrated bridge contact, whereby the movable contact, i.e., for example, the contact spring, could be connected, for instance, to the appertaining current conductor via a stranded conductor. The illustrated current conductors 7 and 8 are implemented as punched/bent parts. However, it would also be conceivable, for instance, to manufacture the input current conductor of one piece with the pole post 4. It is also possible, given a mass production, to not subsequently insert the current conductors into the base 11 but to embed them by extrusion coating during the manufacture of this base.

As was likewise already mentioned, the triggering of the section switch can ensue, among other things, on the basis of a signal of an acceleration sensor, for example of an air bag trigger that is already present anyway. However, it would also be conceivable to employ the lifting armature 28 of the magnet system itself as acceleration sensor, whereby this, of course, would then have to be installed in a corresponding direction and adapted both in terms of mass as well as in terms of the pre-stress of a restoring spring to the provided trigger value.

Although other modifications and changes may be suggested by those skilled in the art, it is the intention of the inventors to embody within the patent warranted hereon all changes and modifications as reasonably and properly come within the scope of their contribution to the art.

I claim:

1. A battery switch for a battery connected to a load, comprising:

an electromagnet system having an armature coupled to a switch pawl;

an input conductor connected to a pole post of the battery;

an output conductor connected to a load circuit;

a movable contact piece producing a switched connection between the input conductor and the output conductor when in a closed position, said movable contact piece being pivotably mounted to move between said closed position and an open position;

a contact carrier carrying the movable contact piece, a break away spring connected to said contact carrier to urge said contact carrier toward the opening position by a tear spring;

a setting arm mounted so as to be movable into engagement with the contact carrier, the switch pawl mounted to lock said setting arm to the contact carrier in articulated fashion, whereby the contact carrier defines a guide slot proceeding approximately in its rotational sense, a setting peg extending from the setting arm engages and that, together with the switch pawl coupled to the armature, is seated pivotable around a pawl axis parallel to the rotational axis thereof, a locking hook that, when the electromagnet system is not excited, locks the setting peg to prevent a displacement in the guide slot; and a manual actuation element operable to move the setting arm in a direction toward the contact carrier and to lock the contact carrier in an engaged position;

the contact carrier, the setting arm and the manual actuation element collaborates such that when the electromagnet system is not excited, the switch pawl locks the setting arm to the contact carrier and the setting arm, in its engaged position, pre-stresses the contact carrier into the closed position; and when the electromagnet system is excited, the switch pawl unlocks the setting arm and the contact carrier is brought into the open by the break away spring.

2. A battery switch according to claim 1, wherein the input conductor and the output conductor respectively comprise fixed contacts in alignment with one another; and the movable contact piece is a bridge contact piece that connects the two fixed contacts.

3. A battery switch according to claim 1, wherein the contact carrier is a contact rocker that is rotatably seated and includes a first lever arm carrying the movable contact piece as well as a second lever arm that collaborates with the setting arm.

4. A battery switch according to claim 3, wherein the first lever arm is formed by a leaf spring secured to the contact rocker.

5. A battery switch according to claim 1, further comprising:

a pawl spring that urges the switch pawl into its locking position.

6. A battery switch according to claim 1, further comprising:

a lifter armature in said electromagnet system, a trigger peg in engagement with the switch pawl, the trigger peg being perpendicular to a longitudinal axis of said lifter armature and parallel to the swivelling axis of the switch pawl.

7. A battery switch according to claim 6, wherein the trigger peg engages into an oblong hole of the switch pawl that extends approximately in the direction of the rotational movement of the contact rocker.

8. A battery switch according to claim 3, wherein the setting arm together with the manual actuation element forms a toggle lever system that, in its stretched condition, acts approximately in a closing direction of the contact rocker on the second lever arm thereof, and further comprising:

a detent against which an articulation point of said toggle lever system is pre-stressed by the break away spring when a dead point is passed.

9. A battery switch according to claim 8, wherein the manual actuation element is a rotary switch at whose circumference an articulation point for the setting arm is provided, said articulation point forming the articulation point of the toggle lever system.

10. A battery switch according to claim 1, further comprising:

an external sensor connected to drive said electromagnet system.

11. A battery switch according to claim 6, wherein the lifter armature is an acceleration sensor on the basis of its mass and pre-stress.

12. A battery switch according to claim 1, further comprising:

a current sensor that effects the excitation of the electromagnet system when a current threshold is exceeded connected to one of the input conductor and the output conductor.

13. A battery switch according to claim 12, wherein the current sensor is a magnetic flux sensor.

14. A battery switch according to claim 1, wherein the input conductor is a metal rail rigidly connected to the pole post.

15. A battery switch according to claim 14, further comprising:

a housing adapted to the pole post and enclosing elements of the battery switch.

16. A battery switch according to claim 1, further comprising:

an emergency output conductor conducted toward an outside from the input conductor parallel to the switched connection of the battery switch.

17. A battery switch according to claim 15, wherein said housing provides a separate space for an electronic drive circuit in the housing.

* * * * *